US006796440B2

(12) United States Patent
Wang

(10) Patent No.: US 6,796,440 B2
(45) Date of Patent: Sep. 28, 2004

(54) DISPLAY RACK FOR LONG-HANDLED SPRINKLERS

(75) Inventor: King-Yuan Wang, Changhua Hsien (TW)

(73) Assignee: Yuan Mei Corp., Changhua Hsien (TW)

( * ) Notice: Subject to any disclaimer, the term of this patent is extended or adjusted under 35 U.S.C. 154(b) by 47 days.

(21) Appl. No.: 10/175,044

(22) Filed: Jun. 20, 2002

(65) Prior Publication Data

US 2003/0234230 A1 Dec. 25, 2003

(51) Int. Cl.[7] ..... A47F 7/00

(52) U.S. Cl. ..... 211/70.6; D6/469; 239/273; 211/183

(58) Field of Search ..... 211/60.1, 70.6, 211/74, 70, 189, 65, 71.01, 13.1, 62, 64, 68, 70.4, 70.8, 69.5, 183; 138/106; 285/124.3, 124.4; 239/273, 280, 288, 288.3, 288.5, 525, 532; D6/469, 466–468, 475–476, 589; 206/443, 372, 375, 562–564; 248/512, 519, 524, 75, 89, 80

(56) References Cited

U.S. PATENT DOCUMENTS

| | | | | | |
|---|---|---|---|---|---|
| 160,339 | A | * | 3/1875 | Ladd | 211/62 |
| 1,148,895 | A | * | 8/1915 | Gehl | 211/60.1 |
| 3,759,538 | A | * | 9/1973 | Fabiano | 280/47.35 |
| 4,190,166 | A | * | 2/1980 | Allsop | 211/160.1 |
| 4,641,755 | A | * | 2/1987 | Oliver et al. | 211/60.1 |
| 4,929,427 | A | * | 5/1990 | Guala | 422/100 |
| 5,011,028 | A | * | 4/1991 | Sweeney | 211/60.1 |
| 5,106,297 | A | * | 4/1992 | Discko, Jr. | 433/77 |
| 5,628,400 | A | * | 5/1997 | Feder | 206/379 |
| 5,810,177 | A | * | 9/1998 | Cabiran | 211/70.6 |
| 6,230,985 | B1 | * | 5/2001 | Wang | 239/273 |
| D454,013 | S | * | 3/2002 | Wang | D6/469 |
| D458,774 | S | * | 6/2002 | Chao | D6/469 |
| 6,398,045 | B1 | * | 6/2002 | Chao | 211/181.1 |
| 6,471,076 | B1 | * | 10/2002 | Chen | 211/70.6 |
| 6,474,481 | B1 | * | 11/2002 | Liu | 211/69 |
| 6,508,369 | B2 | * | 1/2003 | Wang | 211/60.1 |
| 2003/0015486 | A1 | * | 1/2003 | Chen | 211/70 |

* cited by examiner

*Primary Examiner*—Jennifer E. Novosad
(74) *Attorney, Agent, or Firm*—Troxell Law Office PLLC

(57) ABSTRACT

A display rack for long-handled sprinklers is mainly made up of an upper board having retaining holes, and a base board having holding holes. The retaining holes each have arch indented grooves, protrusion edges, and an arc retaining flange to receive a locating section of each long handled sprinkler. The holding holes, corresponding to the retaining holes, hold a lower section of each long-handled sprinkler to stably locate the long-handled sprinkler at both upper and lower sections onto the display rack. Accordingly, a plurality of long-handled sprinklers can be located securely and upright in the display rack with sprinkle heads adjusted into a clean and beautiful arrangement for display.

4 Claims, 6 Drawing Sheets

DISPLAY RACK FOR LONG-HANDLED SPRINKLERS

BACKGROUND OF THE INVENTION

The present invention is related to a display rack for long-handled sprinklers wherein said display rack is mainly made up of an upper supporting board having retaining holes disposed thereon to locate the upper section of a long-handled sprinkler, and a base board having holding holes disposed thereon to hold the lower section of said long-handled sprinkler. Thus, said long-handled sprinkler having a sprinkle head disposed at the top is located securely at both upper and lower sections thereof onto said display rack. In addition, said sprinkle head can be adjusted to point at the direction as desired for clean and beautiful display of the same thereon.

Please refer to FIG. 1 showing a first conventional display rack for long-handled sprinklers. Said conventional display rack 10 is made up of an upper board 11 having a multiple of oval locating columns 12 disposed thereon, a base board 13 having a multiple of oval hollow posts 14 corresponding to said oval locating columns 12 thereof, and a multiple of smaller staged-grooves 15 disposed at the bottom of said oval hollow posts 14 thereof. In practical use, a long-handled sprinkler 40 is led through said oval locating column 12, passing through said oval hollow post 14 and placed onto said smaller staged groove 15 thereof at the lower section thereof. There are several drawbacks to such conventional display rack 10. Said upper supporting board 11 can only loosely and partially locate the upper section of said long-handled sprinkler 40 via said oval locating column 12, which makes it impossible to adjust the angle and direction of said sprinkler 40 to fit the location of said display rack 10. It is, thus, limited in the space of display thereof. Second, said long-handled sprinkler 40 can only slant against said oval locating column 14 and oval hollow post 15 thereof for location, which makes it look rather disorderly in arrangement. Third, when said display rack 10 is moved, said long-handled sprinklers 40 displayed thereon are easily shaken into disorder and need another arrangement, which is quite bothersome and inconvenient.

Please refer to FIG. 2 showing another conventional display rack for long-handled sprinklers. Said another conventional display rack 20 is made up of an upper board 21 having a multiple of inserting holes 22 and locating slots 221 disposed thereon for said long-handled sprinkler 40 to be led and located at said locating slots 221 thereon, and a base board 23 having a multiple of oval grooves 24 extending downwards for the lower section of said long-handled sprinkler 40 to be located therein. There are some disadvantages to such conventional display rack 20. First, said long-handled sprinkler 40 is slantingly led through said inserting hole 22 and located at said locating slot 221 thereof in a single direction, enable to be adjusted to fit the location of said display rack 20 thereof. It is also limited in space of display thereof Second, said long-handled sprinkler 40 is leaned against said locating slot 221 thereof for location, which looks disorderly in arrangement and inconvenient for the selection of the consumers. Third, when said display rack 20 is moved, said long-handled sprinkler 40 can be easily dislocated from said locating slot 221 and shaken at said inserting hole 22 thereof. Another arrangement of the same is thus required, which is quite troublesome and inconvenient.

SUMMARY OF THE PRESENT INVENTNION

It is, therefore, the primary purpose of the present invention to provide a display rack for long-handled sprinklers, comprising an upper supporting board having a multiple of retaining holes disposed thereon which, each defined by arch indented grooves protrusion edges, and an arc retaining flange thereon, can locate upright the upper section of said long-handled sprinkler, and a base board having a multiple of holding holes disposed thereon which, each having a circular slant slope and a stop flange disposed therein, can hold the lower section of said long-handled sprinkler in straight position. Besides, said long-handled sprinkler can be easily adjusted in angle and direction to fit the location of said display rack thereof.

It is, therefore, the second purpose of the present invention to provide a display rack for long-handled sprinklers wherein a locating section of said long-handled sprinkler is fit into the space defined by said arch indented grooves and protrusion edges thereof for straight location so that said sprinkler thereof will be not easily shaken when said display rack is moved, and a sprinkle head disposed at the top of said long-handled sprinkler is adjusted to point at the direction as desired for clean and beautiful arrangement of the same on said display rack thereof.

It is, therefore, the third purpose of the present invention to provide a display rack for long-handled sprinklers wherein the lower section of said long-handled sprinkler is led through said circular guide slope and held in straight by said stop flange thereof for easily and quick location of the same.

DETAILED DESCRIPTION OF THE PREFERRED EMBODIMENTS

Figure 1:
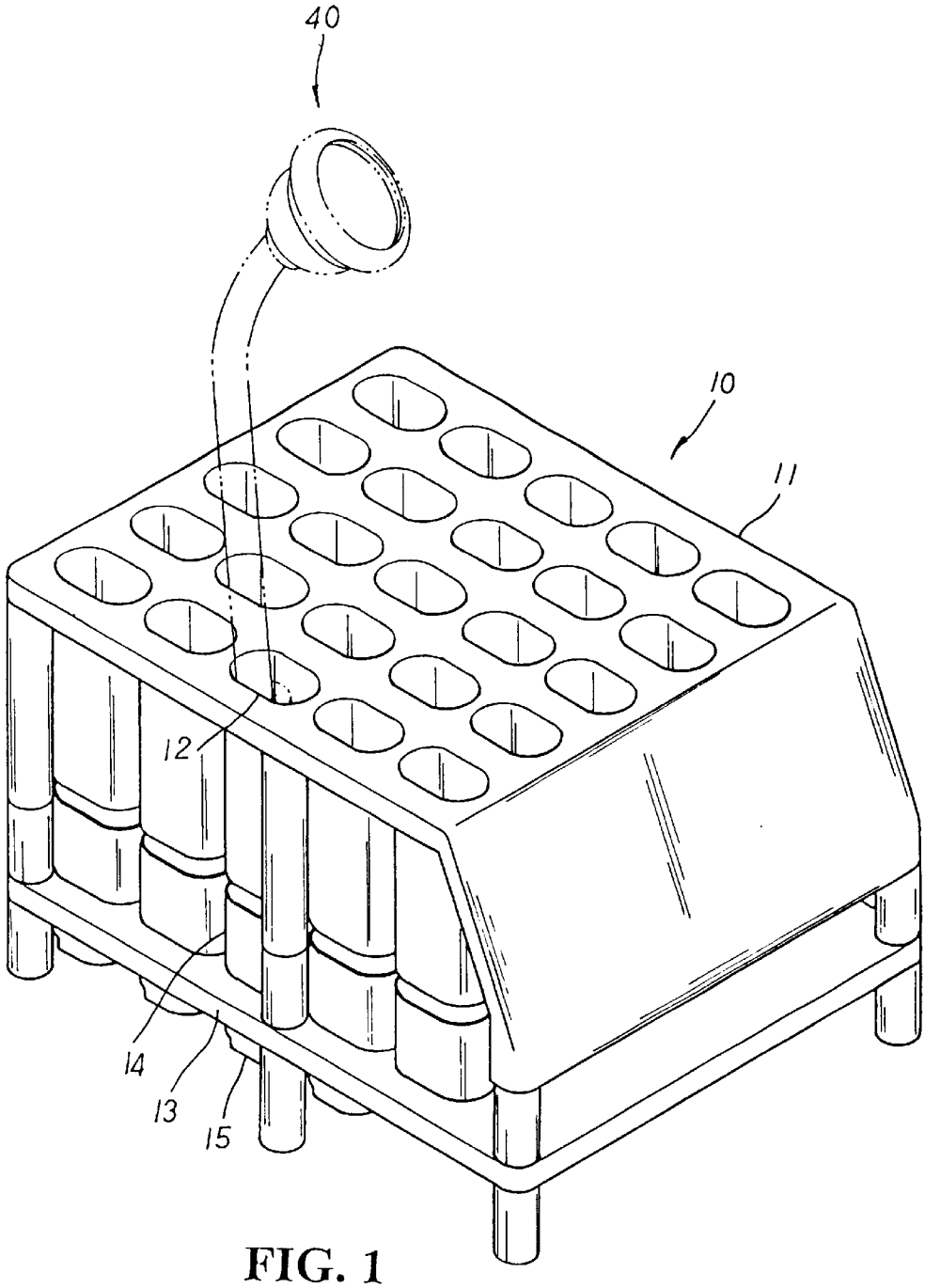
FIG. 1 PRIOR ART
FIG. 1 is a conventional display rack for long-handled sprinkler in practical use.
Figure 2:
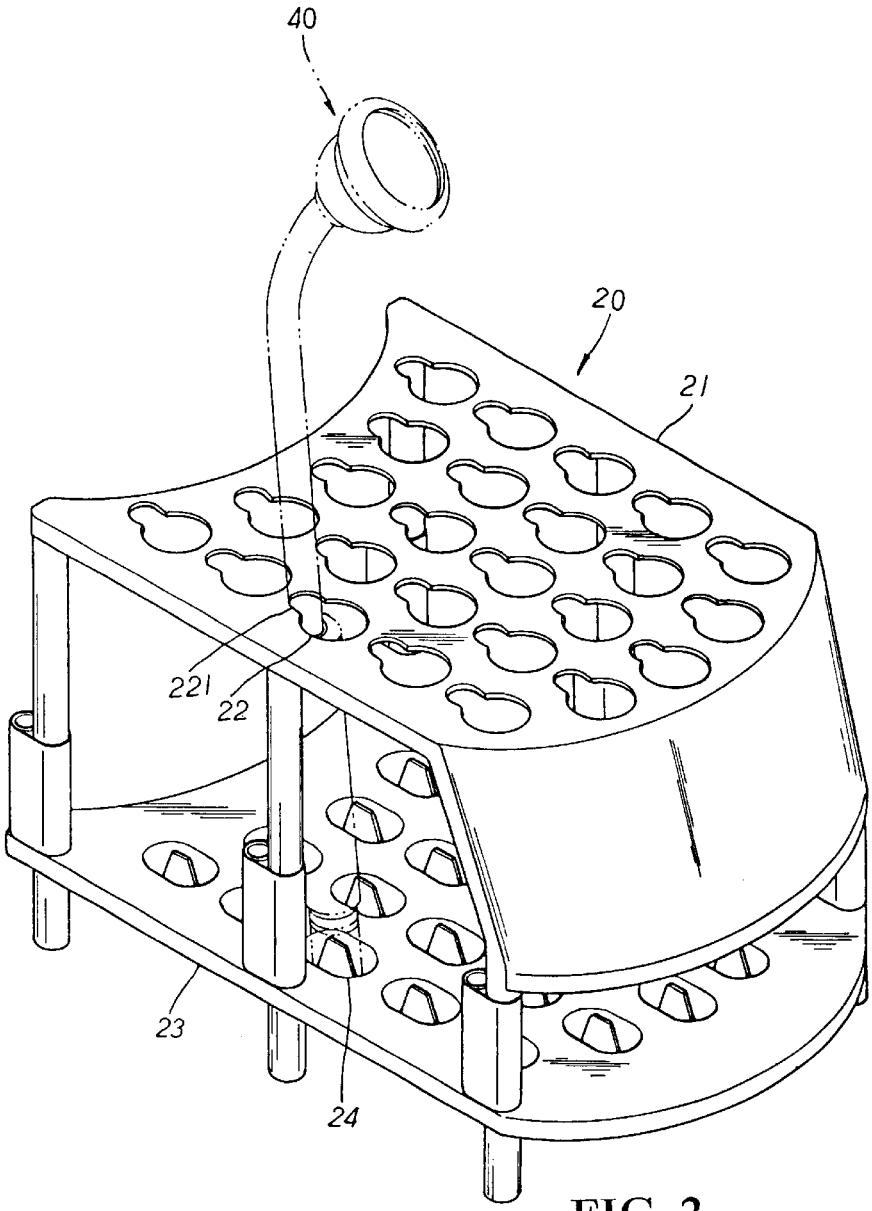
FIG. 2 PRIOR ART
FIG. 2 is another conventional display rack for long-handled sprinkler in practical use.
Figure 3:
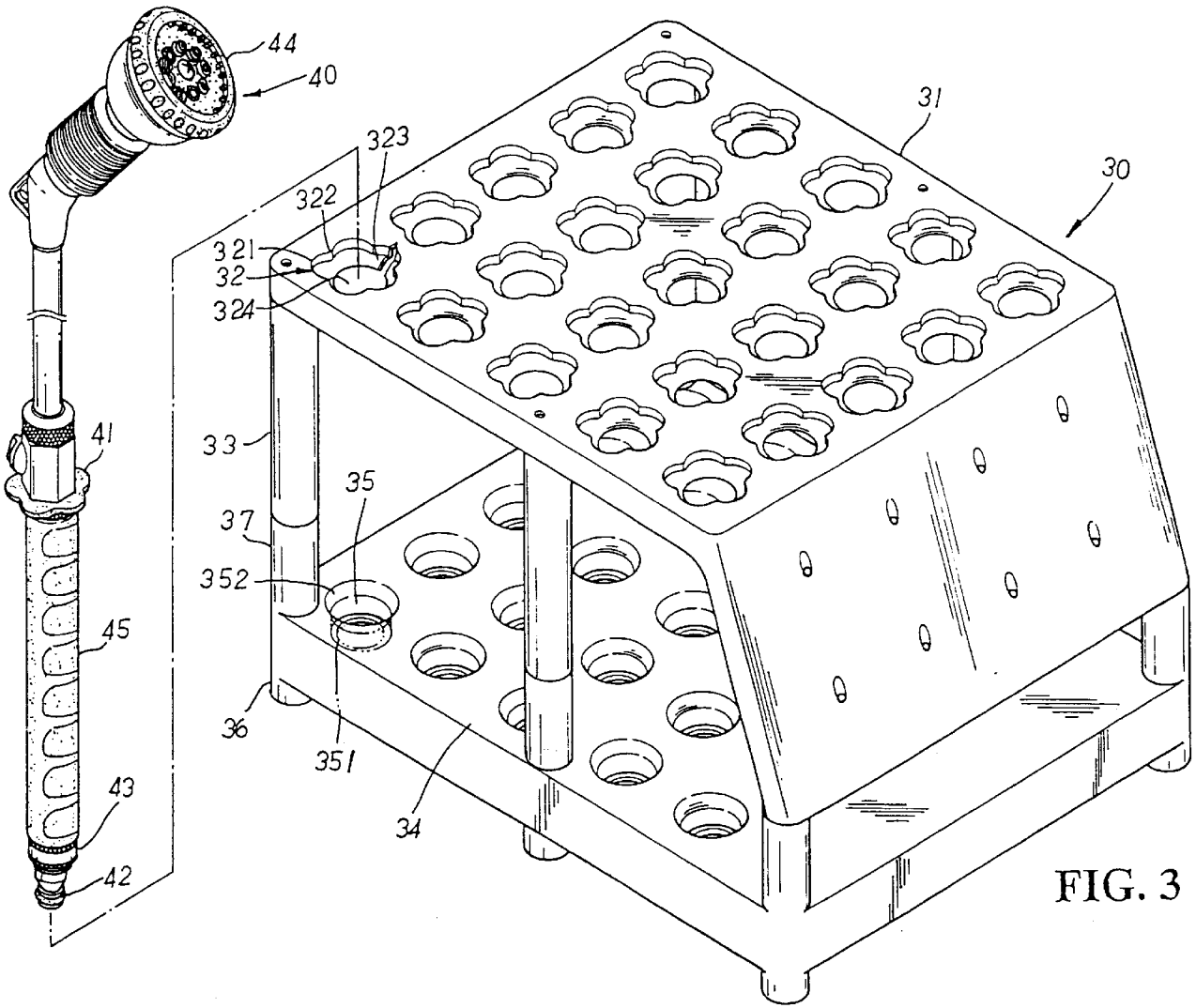
FIG. 3 is a perspective exploded view of the present invention.

Please refer to FIG. 3. The present invention is related to a display rack for long handled sprinkler wherein a display rack 30, having an oblique front board, is mainly made up of an upper supporting board 31 with a multiple of retaining holes 32 disposed thereon, a multiple of equidistant support posts 33 extending downwards at both lateral sides of said upper support boards 31 thereof, a base board 34 with a multiple of holding holes 35 disposed thereon, and a multiple of short legs 36 and insert columns 37 extending at both lateral sides of said base board 34 thereof, corresponding to said equidistant support posts 33 thereof.

Each of said retaining holes 32 thereof is provided with a plurality of arch indented grooves 321 and protrusion edges 322, defining a space thereon to fit the shape of a locating section 41 of a long-handled sprinkler 40, and an arc retaining flange 323 projecting at the bottom of said indented grooves 321 and protrusion edges 322 thereof to circumscribe a slot 324 disposed at the center thereof. Said long-handled sprinkler 41 is led through said slot 324 thereof with said locating section 41 thereof fitting into the space defined by said arch indented grooves 321 and protrusion edges 322 and retained thereto via said arc retaining flange 323 thereof. Each of said holding holes 35 thereof, corresponding to said retaining holes 32 of said upper supporting board 31, is provided with a stop flange 351 disposed at the bottom thereof and a circular guide slope 352 circumscribing the inner side thereof. Said circular guide slope 352 thereof is joined to said stop flange 351 in an obtuse angle, defining a staged through hole, wide at the top and narrow at the bottom, at the interior of said holding hole 35 for the location of a coupling head 43 and a connecting means 42 disposed at the lower section of said long-handled sprinkler 40 thereof. Said coupling head 43 thereof is led through said holding hole 35 and located by said stop flange 351 while said connecting means 42 thereof is led to come out at the other end thereof. Said base board 34 having short legs 36 disposed at the bottom thereof is assembled to said upper supporting board 31 via said inserting columns 37 thereof engaging with said support posts 33 thereof to provide a display rack 30 of proper high to fit the length of a handle section 45 of said sprinkler 40 thereof.

Figure 4:
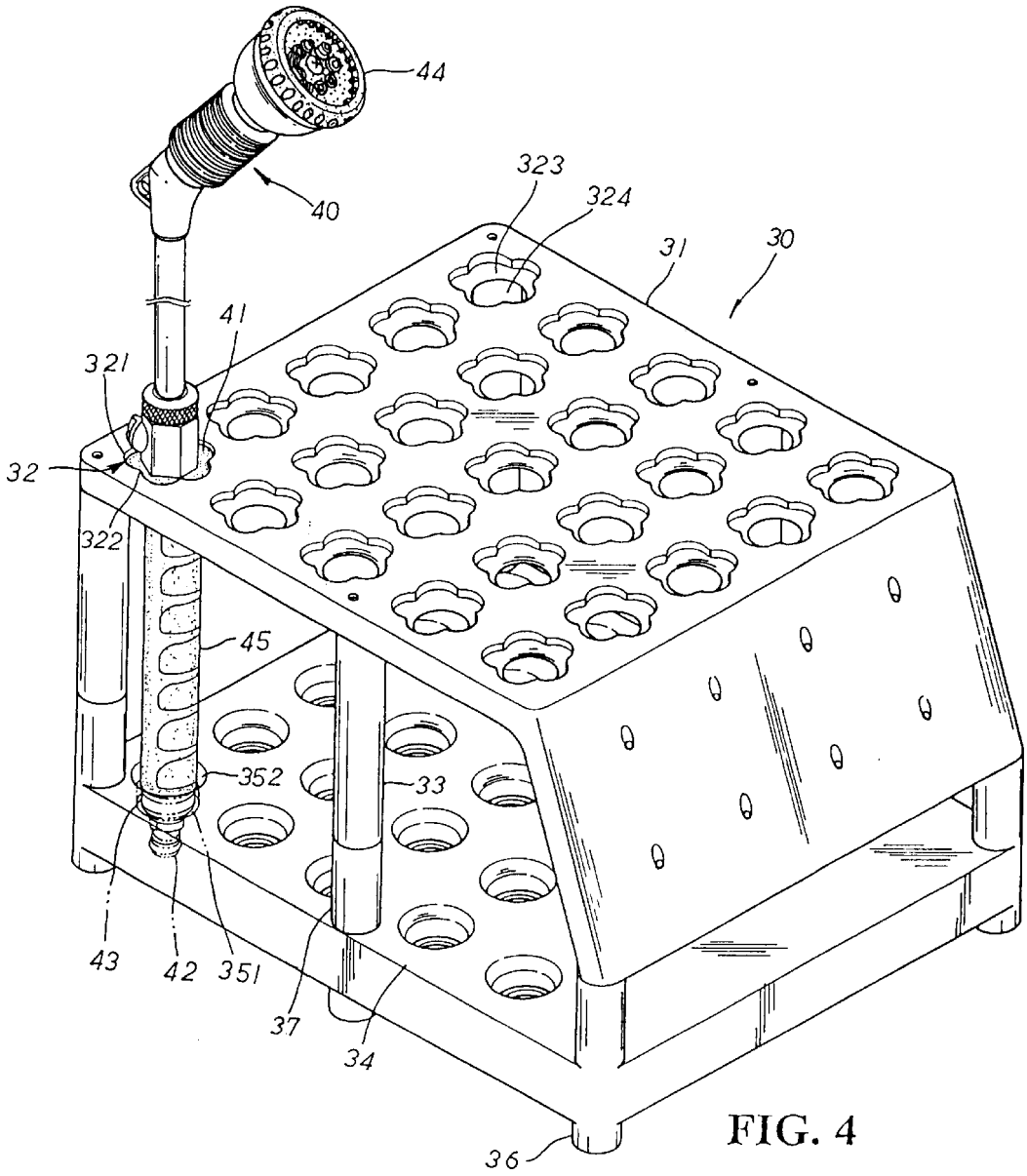
FIG. 4 is a perspective view of the present invention in practical use.
Figure 5:
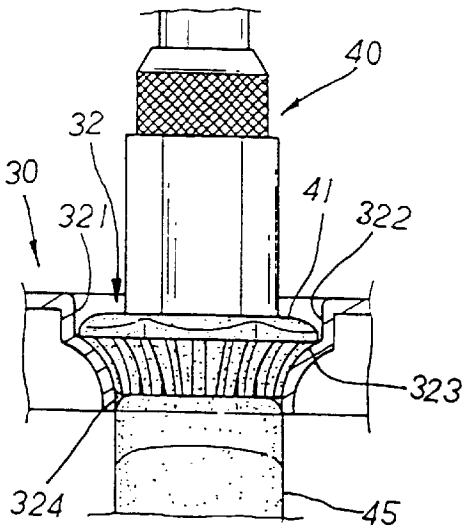
FIG. 5 is a partially sectional view of the present invention.
Figure 6:
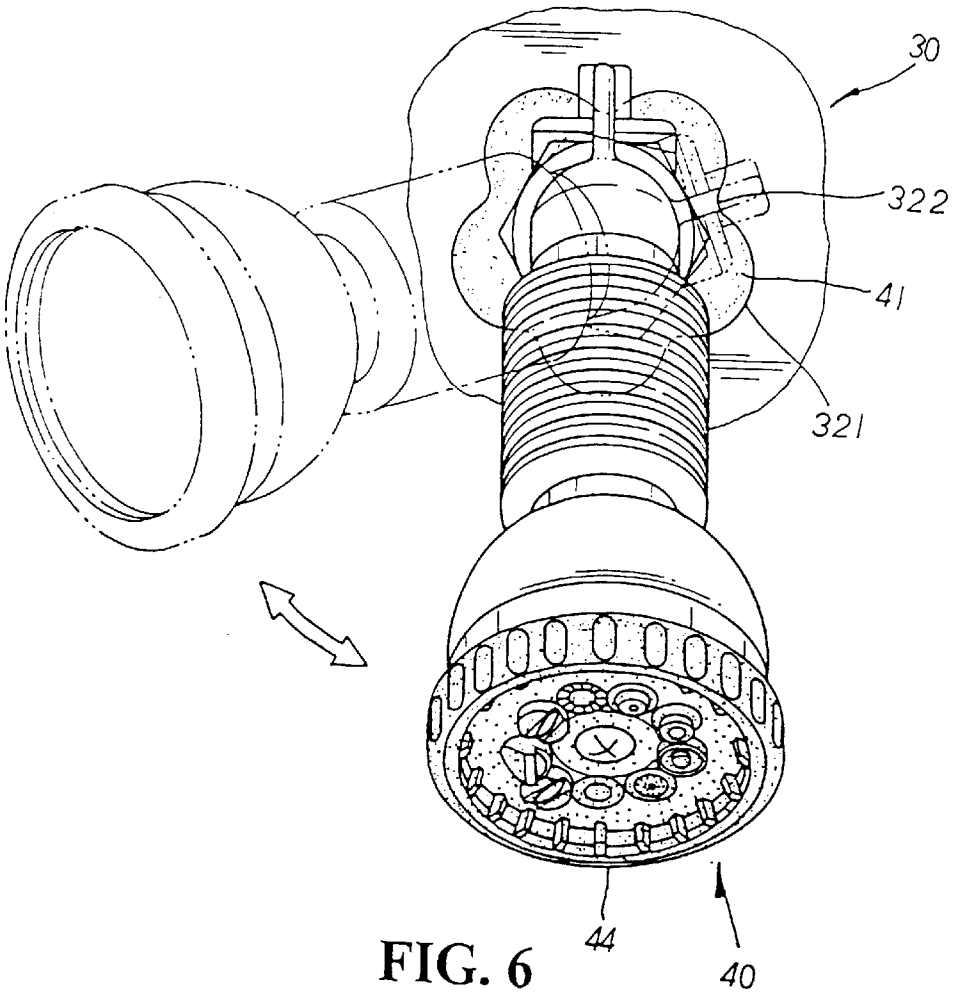
FIG. 6 is a diagram showing the adjustment of a sprinkle head of said long-handled sprinkler on the present invention.

Please refer to FIG. 4. To display said long-handled sprinkler 40, said sprinkler 40 thereof is led through one of the retaining holes 32 of said upper supporting board 31. Said connecting means 42 along with said coupling head 43 disposed at one end of said handle section 45 thereof is led through the corresponding holding hole 35 disposed at said base board 34 thereof, passing through said circular guide slope 352 thereof to come out at the other end thereof with said coupling head 43 thereof abutting against said stop flange 351 thereof to locate the lower section of said long-handled sprinkler 40 thereof in straight position. Meanwhile, said locating section 41 of said sprinkler 40 thereof is received at the space defined by said arch indented grooves 321 and protrusion edges 322 thereof and located upright thereto via said arch retaining flange 323 to stably position the upper section of said long-handled sprinkler 40 at said upper supporting board 31 thereof as shown in FIG. 5. Said long-handled sprinkler 40 having a sprinkle head 44 disposed at the upper section thereof can also be lifted upwards to remove said locating section 41 out of said retaining hole 32 thereof so as to adjust the direction of said sprinkle head 44 thereof for display. Said sprinkle head 44 can be rotated to point at any directions as desired on said display rack 30 thereof as shown in FIG. 6. After said sprinkle head 44 being adjusted into a proper direction, said long-handled sprinkler 40 is relocated back to the retaining hole 32 with said locating section 41 thereof re-abutting against said arch retaining flange 323 thereof. Accordingly, a multiple of said long-handled sprinklers 40 can be located onto said display rack 30 with each said sprinkle head 44 thereof adjusted to point at the same direction for clean and beautiful arrangement of the same thereon. Besides, securely located at both upper and lower sections thereof via said upper supporting board 31 and base board 34, said long-handled sprinklers 40 will not be easily shaken into disarrangement when said display rack 30 is moved.

Figure 7:
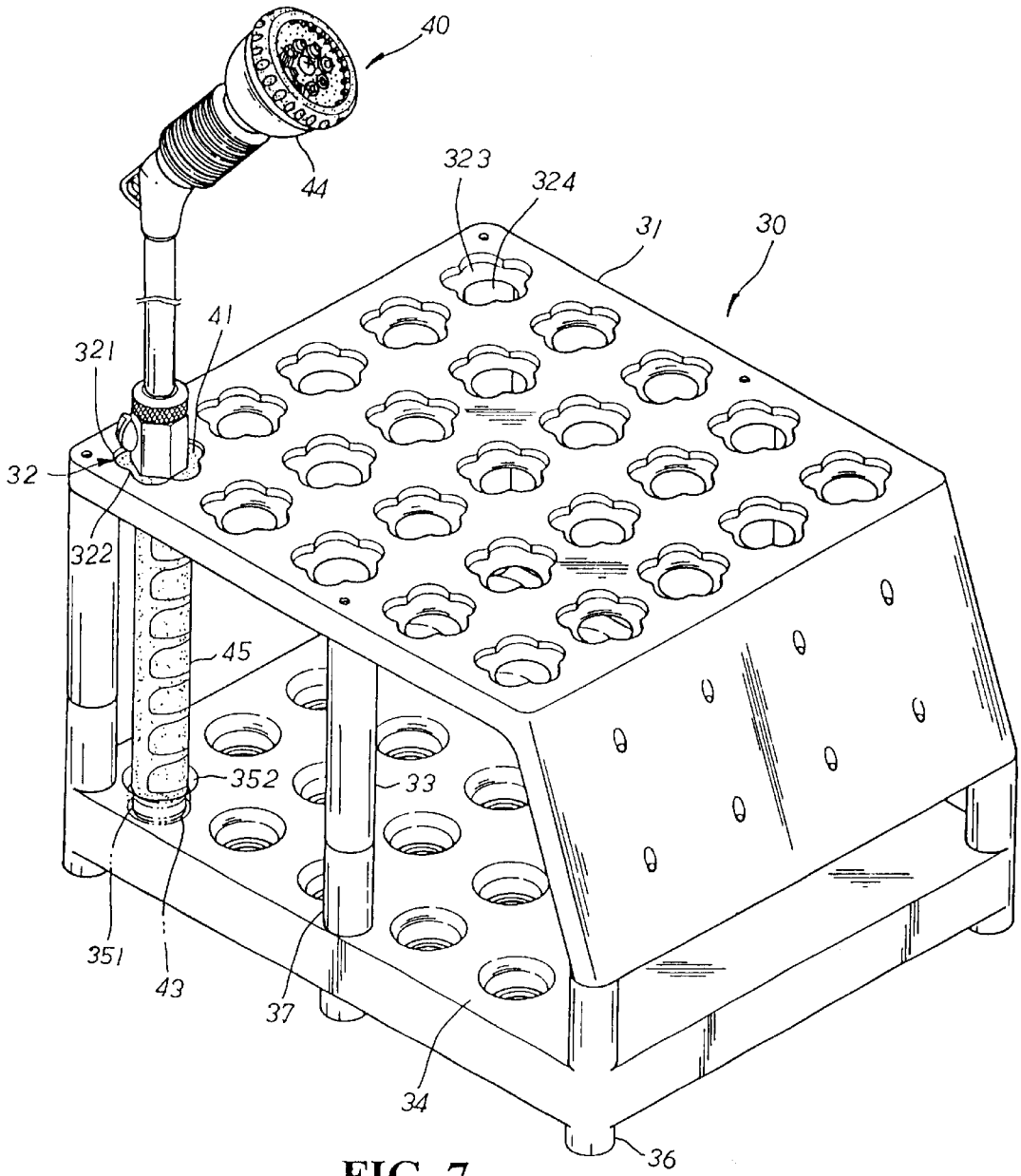
FIG. 7 is another embodiment of the present invention in practical use.

Please refer to FIG. 7. When said long-handled sprinkler 40 is provided with a coupling head 43 but no connecting means 42, said coupling head 43 is directly led through said circular guide slope 352 and abutted against the stop flange 351 of said holding hole 35 to locate the lower section of said long-handled sprinkler 40 onto said base board 34 thereof while the upper section of said long-handled sprinkler 40 is located by the retaining hole 32 of said upper supporting board 31 thereof.

What is claimed is:

1. A combination of a display rack and handled sprinklers having handles comprising:

a) a display rack having:

i) an upper supporting board having a plurality of retaining holes, each retaining hole having a plurality of arch indented grooves and a plurality of protrusion edges;

ii) a base board having a plurality of holding holes, each holding hole being aligned with one of the retaining holes in the upper supporting board, each holding hole having a stop flange at a bottom thereof and a circular guide slope circumscribing an inner side thereof;

iii) a plurality of support posts being connected at a first end to lateral edges of the upper supporting board; and iv) a plurality of legs being connected to lateral edges of the base board, each leg being aligned with one of the support posts, each leg having an insert column, wherein a second end of each support post is inserted into one of the insert columns thereby connecting the upper supporting board to the base board; and b) a plurality of handled-sprinklers having handles, each of the handled sprinklers having:

i) a first end;

ii) a second end; and iii) a locating section between the first end and the second end, the locating section of each handled sprinkler being adjustably inserted into a selected retaining hole in the upper supporting board, and the second end of the handled sprinkler being inserted into the aligned holding hole of the base board to display a sprinkler head on the first end of the handled sprinkler, wherein the locating section of each of the handled sprinklers has a complimentary structure that mates with the plurality of arch indented grooves and the plurality of protrusion edges of each of the retaining holes, and the circular guide slope and the stop flange of each holding hole substantially conforms to the shape of the second end of each handled sprinkler.

2. The combination of the display rack and handled sprinklers according to claim 1, wherein each retaining hole has an arc retaining flange projecting at a bottom of the plurality of arch indented grooves and the plurality of protrusion edges.

3. The combination of the display rack and handled sprinklers according to claim 1, wherein the second end of each of the handled sprinklers has a connecting device and a coupling head, the connecting device and coupling head being slidably fitted into one of the holding holes.

4. The combination of the display rack and handled sprinklers according to claim 1, wherein the second end of each of the handled sprinklers has a coupling head, the coupling head being slidably fitted into one of the holding holes.

* * * * *